United States Patent [19]

Grabbe et al.

[11] Patent Number: 4,836,791

[45] Date of Patent: Jun. 6, 1989

[54] HIGH DENSITY COAX CONNECTOR

[75] Inventors: Dimitry G. Grabbe, Middletown; Richard F. Granitz, Harrisburg; Roel J. Bakker, York; Donald W. Milbrand, Jr., Mechanicsburg, all of Pa.; Earl E. Masterson, Minneapolis, Minn.

[73] Assignee: AMP Incorporated, Harrisburg, Pa.

[21] Appl. No.: 119,081

[22] Filed: Nov. 16, 1987

[51] Int. Cl.[4] ..... H01R 9/09

[52] U.S. Cl. ..... 439/79; 439/81; 439/95

[58] Field of Search ..... 439/79–81, 439/76, 65, 95, 609, 630, 632, 634, 636, 637

[56] References Cited

U.S. PATENT DOCUMENTS

| | | | |
|---|---|---|---|
| 3,676,832 | 7/1972 | Judge et al. | 339/75 M |
| 3,864,000 | 2/1975 | Colter | 339/17 LC |
| 4,200,347 | 4/1980 | Sinclair et al. | 339/17 CF |
| 4,401,355 | 8/1983 | Young | 339/17 LC |
| 4,451,107 | 5/1984 | Dola et al. | 339/17 LC |
| 4,533,203 | 8/1986 | Feldman et al. | 339/17 LM |
| 4,583,807 | 4/1986 | Kaufman et al. | 339/17 LC |
| 4,592,616 | 6/1986 | Drew et al. | 339/177 R |
| 4,637,669 | 1/1987 | Tajuma | 439/95 |
| 4,655,518 | 4/1987 | Johnson et al. | 339/17 LC |
| 4,659,155 | 4/1987 | Walkup et al. | 439/79 |
| 4,686,607 | 8/1987 | Johnson | 439/81 |
| 4,686,609 | 8/1987 | Johnson | 439/81 |
| 4,755,145 | 7/1988 | Johnson et al. | 439/61 |

*Primary Examiner*—P. Austin Bradley
*Attorney, Agent, or Firm*—Bruce J. Wolstoncroft

[57] ABSTRACT

The present invention is directed to a multi-pin coax connector assembly having connector housings made of metal or conductive plastic which serves as a reference ground for all signals. The connectors have passages extending therethrough. Pin and socket terminals are insert molded with insulating material and are positioned in the passages. The insulating material spaces the terminals from the conductive connector housing as well as providing air gaps along most of the length of the terminals. The air gaps cooperate with the insulating material to provide controlled impedance. As the signals travel at a high rate of speed along the terminals, the terminals are bent to minimize the reflection of the signal. The connectors are provided with power and ground busses along the outside surfaces thereof, the busses of the first connector making electrical connection with the respective busses of the second connector. A camming assembly means is also provided to cam the terminals of the connectors together, which provides for a positive wipe action as the terminals of the connectors are cammed into electrical engagement with each other. The camming assembly means also allows for reduced insertion force of the connectors, as the terminals of one connector do not engage the terminals of the other connector until the camming assembly means is operated.

20 Claims, 8 Drawing Sheets

74
101
6
91
77
38
81
8
93
10
97
104
24
76
116
22
82
102
114
116
2
88
26
114
20
80
106
172
4
162
98

82
114
10
114
116
95
85
106
112
16
112
102
76
26
80
110
110
84
86
78
101
101
88
92
90
20
96
94
172
4
160
174

HIGH DENSITY COAX CONNECTOR

FIELD OF THE INVENTION

The present invention relates to an electrical connector for printed circuit boards and more particularly to a high speed coaxial connector for electrically connecting two circuit boards together.

BACKGROUND OF THE INVENTION

Current technology utilizes removably connected printed circuit boards. A daughter board is removably connected to a mother board allowing the daughter board to be replaced as needed. Terminals of the connector electrically connect contact areas of the daughter board to contact areas of the mother board. This requires connectors with multiple rows of closely spaced terminals (0.100 inch centerlines or less) therein. The connectors employ stamped and formed terminals which are inserted into plastic, metal or metallized housings using dielectric sleeves which are molded onto the terminals.

In current electronic circuits, the use of increasingly higher speed switching signals has necessitated control of impedance for signal transmission. At the connector interfaces between mother boards and daughter boards this has been accomplished primarily by alternating ground terminals with signal terminals in the connectors in order to provide a signal reference path and shielding for the signal path. Traditionally, large numbers of terminals are used for ground, with as many as eight terminals being used as ground for every one that is used for signal Thus in the prior art, the number of terminals used for signal transmission is drastically limited, which in turn limits the amount of contact areas which can be beneficially connected between the mother board and the daughter board for signal connection purposes.

In an attempt to provide a connector which allows all terminals to be used for signal transmission, a coaxial type connector described in U.S. Pat. No. 4,451,107 was devised. Although some of the above mentioned problems where solved, other serious problems arose. At high speed transmission the right angle of the terminals caused reflection of the signals, limiting the effectiveness of the connector at high speed transmission. Also limiting the effectiveness of the connector is the fact that the molded dielectric constant of the material of the housing cannot by itself be low enough for high speed transmission in the high gigahertz range.

Other problems include insertion and manufacturing difficulties. As the number of terminals required increases, the insertion force of the male connector into the female connector becomes impractical. In other words, the insertion force becomes so great that the mating halves of the connector cannot be mated together, or the housing and contacts are damages as insertion occurs. The manufacturing of the connector described in U.S. Pat. No. 4,451,107 is also made impractical by the manufacturing process of die casting the metal housing, injection molding a nylon sleeve, and casting the terminals through the nylon sleeves in the housing. This process of manufacturing is very difficult to control and can lead to faulty connections. Therefore, the configuration of the invention of the above cited reference is impractical for many reasons.

SUMMARY OF THE INVENTION

A multi-pin coax connector assembly having connectors made of metal or conductive plastic is described. The conductive material serving as a reference ground for all signals. Pin and socket terminals, placed in respective connectors are insert molded with insulating material. The insulating material provides the space required between the connector housing and the terminals. The configuration of the insulating material provides for air gaps along most of the length of the terminals, allowing the effective dielectric constant to be lower than any plastic enabling the required controlled impedance of the signal pathway and required speed of the signal to be attained. The connectors are provided with power and ground busses, as well as a camming means. The camming means allows the connectors to be mated under low insertion force conditions. As the connectors are mated together the power and ground busses engage and make electrical engagement with the respective power and ground busses of the mating connector. Once the connectors are mated, the camming means is engaged, forcing the pins and sockets to be completely mated thereby providing a positive wiping action and ensure that a positive electrical connection is effected for all signal pins after the ground and power are connected.

The present invention is directed to an electrical connector assembly having a first electrically conductive connector with housing means. The housing means has at least one row of terminal receiving passages extending from a first surface to a second surface, the terminal receiving passages having an angle therein. First terminals are located in the passages, the terminals having essentially the same configuration as the terminal receiving passages. Dielectric material coaxially surrounds the terminals in designated areas, insulating the terminals from the housing means and providing the spacing required to properly position the terminals in the terminal receiving passages.

A second electrically conductive connector is also provided, the connector having housing means which have at least one row of terminal receiving passages extending therethrough. The passages of the first connector and the second connector are in alignment. Second terminals are located in the terminal receiving passages, mating ends of the second terminals cooperate with mating ends of the first terminals. The second terminals have dielectric coaxially surrounding the terminals in designated areas of the terminal receiving passages. The dielectric insulates the terminals from the housing means and provides the spacing required to properly position the terminals in the passages.

A further object of the present invention is to provide a connector assembly which has reduced insertion force, while still providing a positive wiping action between the first and the second terminals.

A further object of the present invention is to provide a connector assembly which allows for high speed transmission of signals while minimizing reflections and discontinuities which distort the signals.

A further object of the present invention is to provide engagement and connection for power and ground terminals prior to engagement and connection of signal terminals or pins.

DETAILED DESCRIPTION OF THE DRAWINGS

Figure 1:
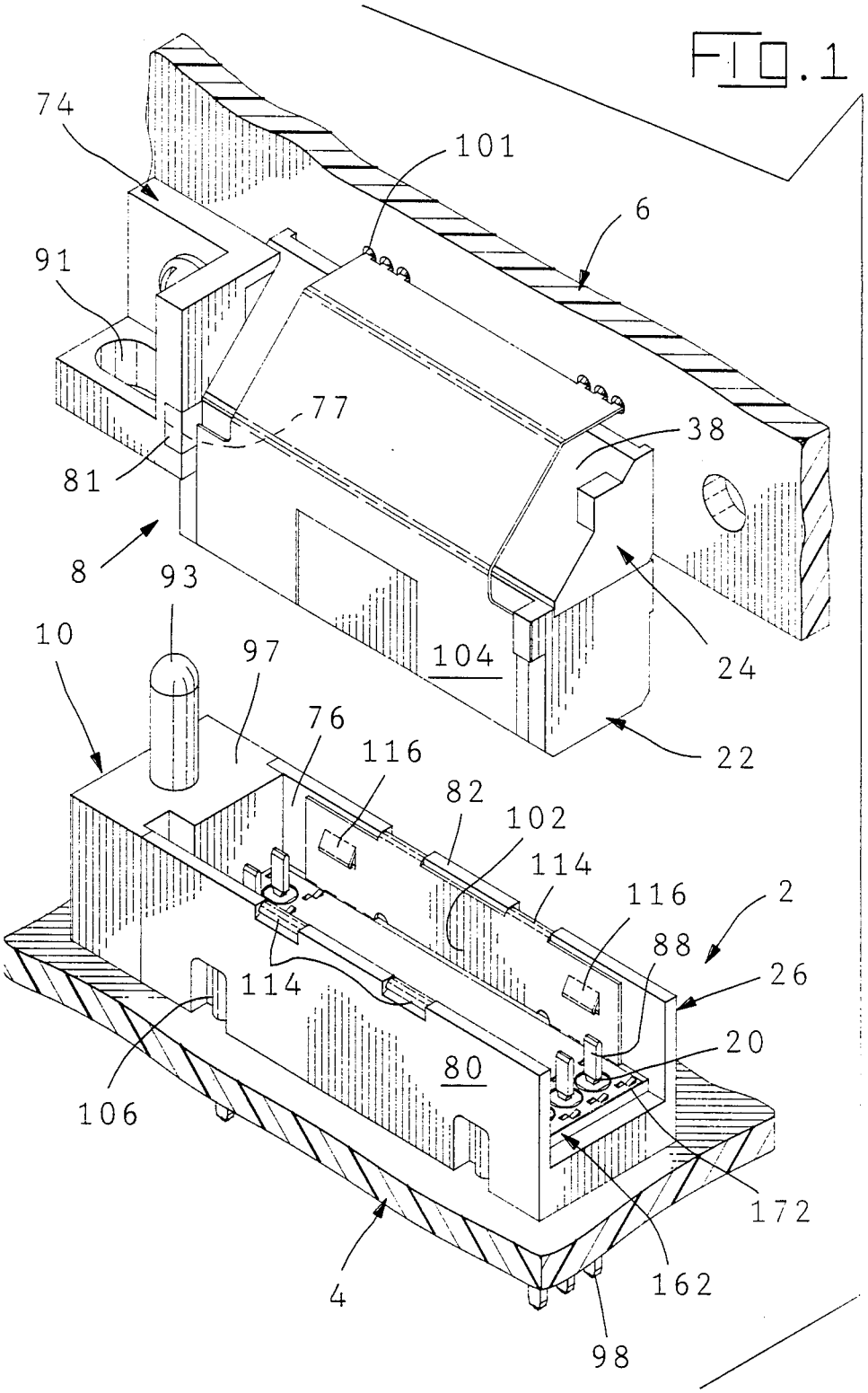
FIG. 1 is a perspective view of a connector assembly showing a plug connector exploded from a receptacle connector.

A low insertion force (LIF) co-axial connector assembly 2 for electrically connecting a mother board 4 to a daughter board 6 is comprised of an electrical plug connector 8 and an electrical receptacle connector 10 which mate together to form connector assembly 2. Each connector 8, 10 has a plurality of terminal receiving passages 12, 14, 16 extending therethrough, each of which is profiled to receive a respective terminal 18, 20 therein. Terminals 18, 20 are insulated from the conductive housings of the connectors by an appropriate dielectric material.

Connectors 8, 10 have housings 22, 24, 26 which are molded from metal or metallized plastic having the appropriate conductive characteristics. Metal plating may be performed on a molded plastic housing to provide these required conductive characteristics.

Figure 2:
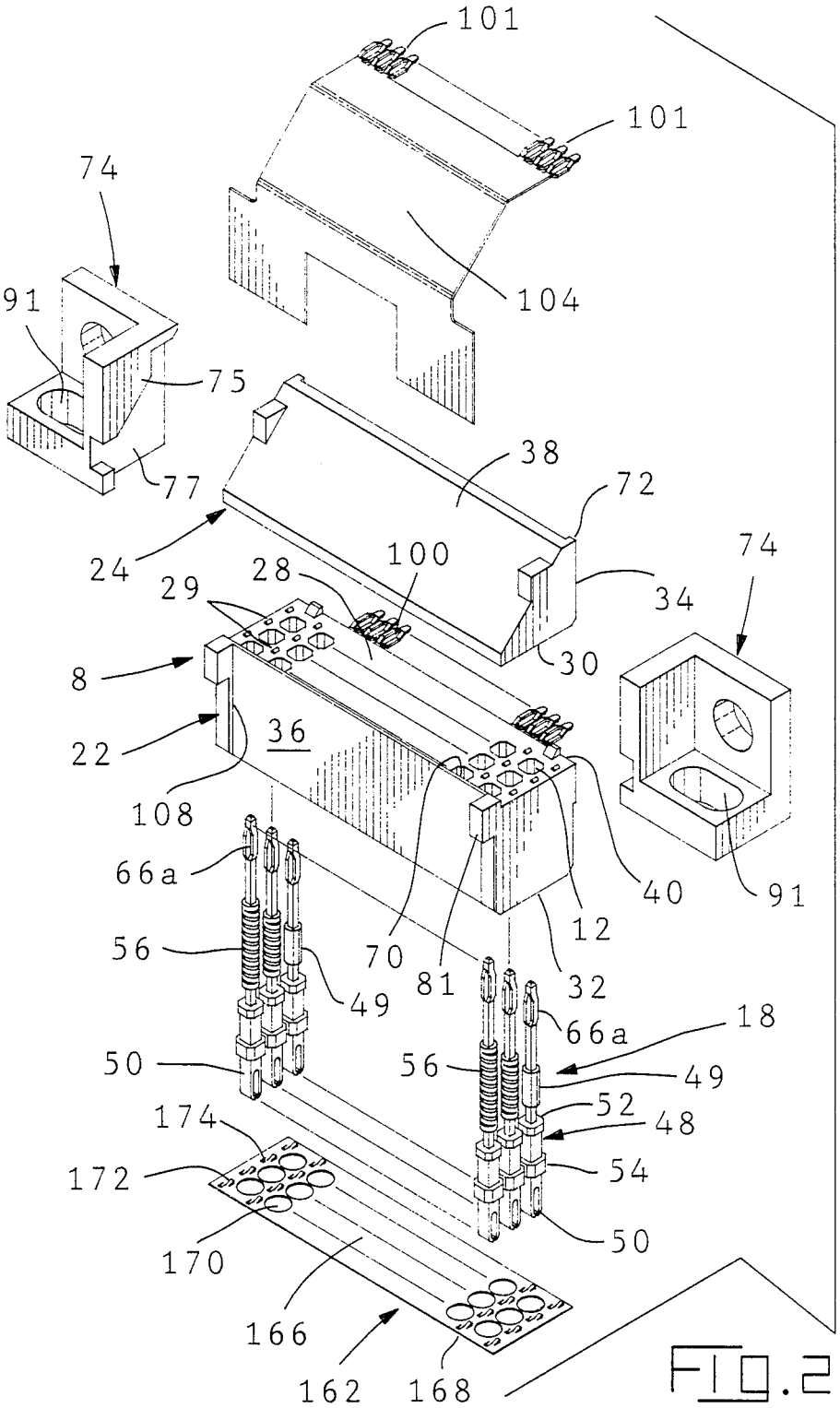
FIG. 2 is an exploded perspective view of the plug connector.
Figure 4:
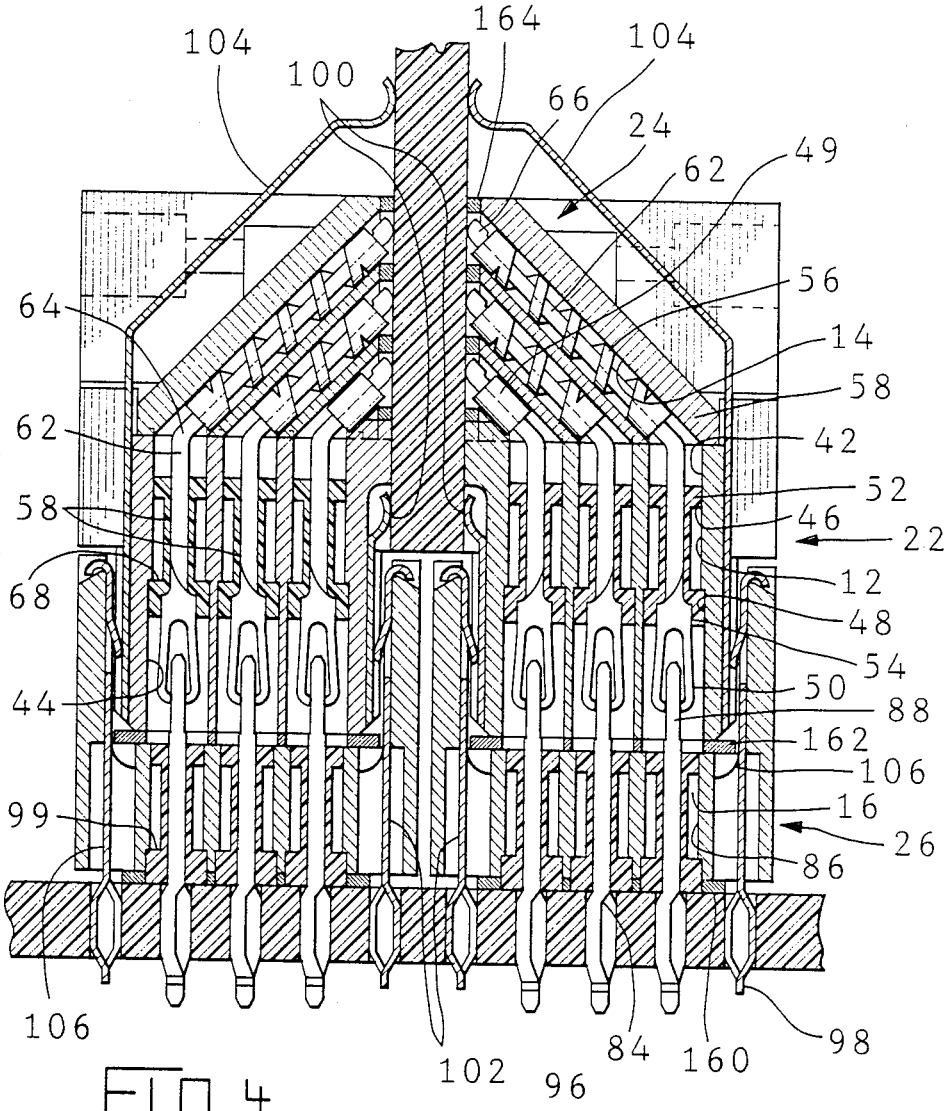
FIG. 4 is a cross-sectional view of the connector assembly when the plug connector is fully inserted into the receptacle connector.
Figure 5:
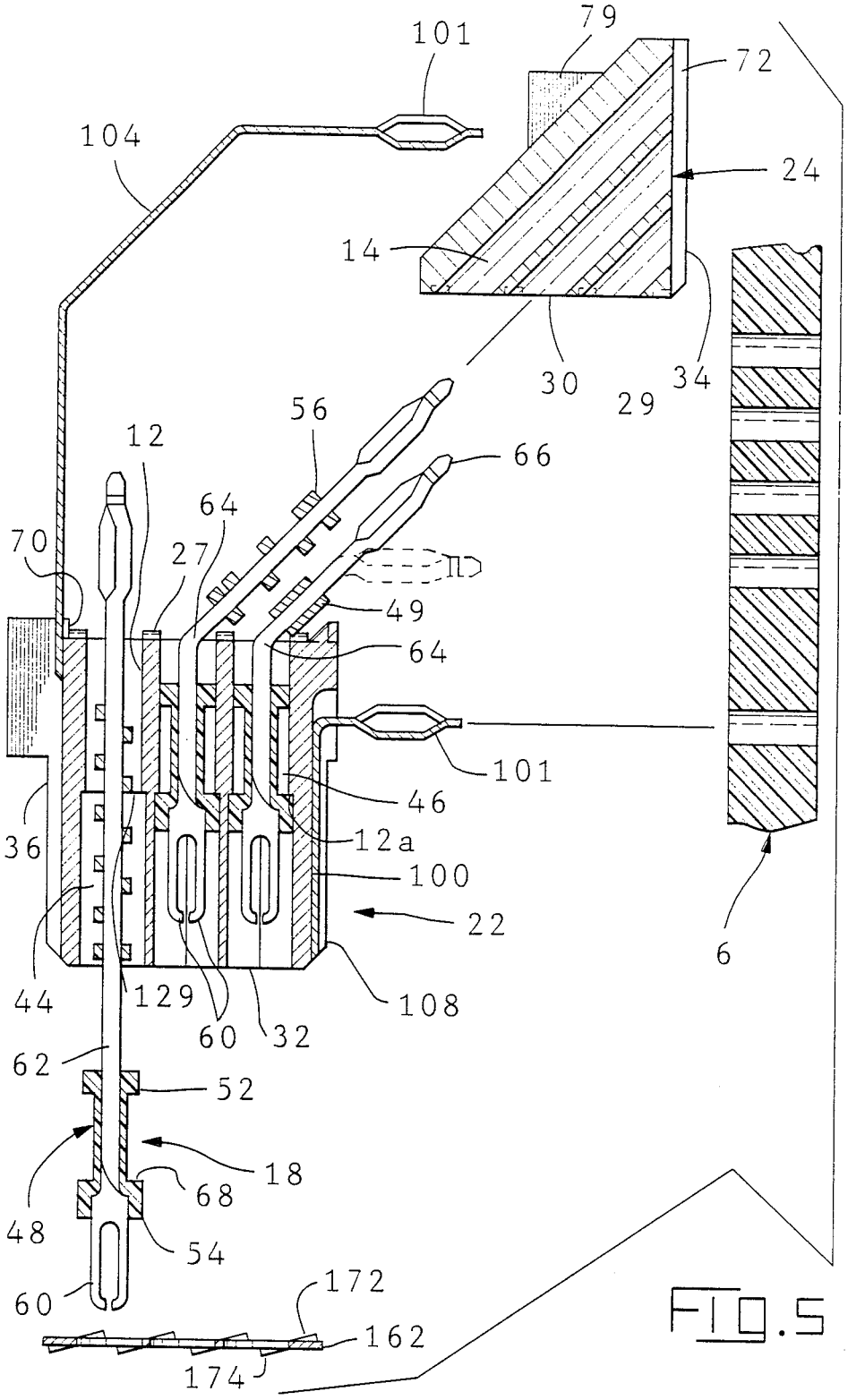
FIG. 5 is a partially exploded cross-sectional view of the plug connector.

Plug connector 8, as shown in FIGS. 2, 4 and 5 is comprised of mating conductive housing 22 and terminal support conductive housing 24. Rear surface 28 of mating housing 22 abuts front surface 30 of terminal support housing 24 when plug connector 8 is fully assembled.

Figure 3:
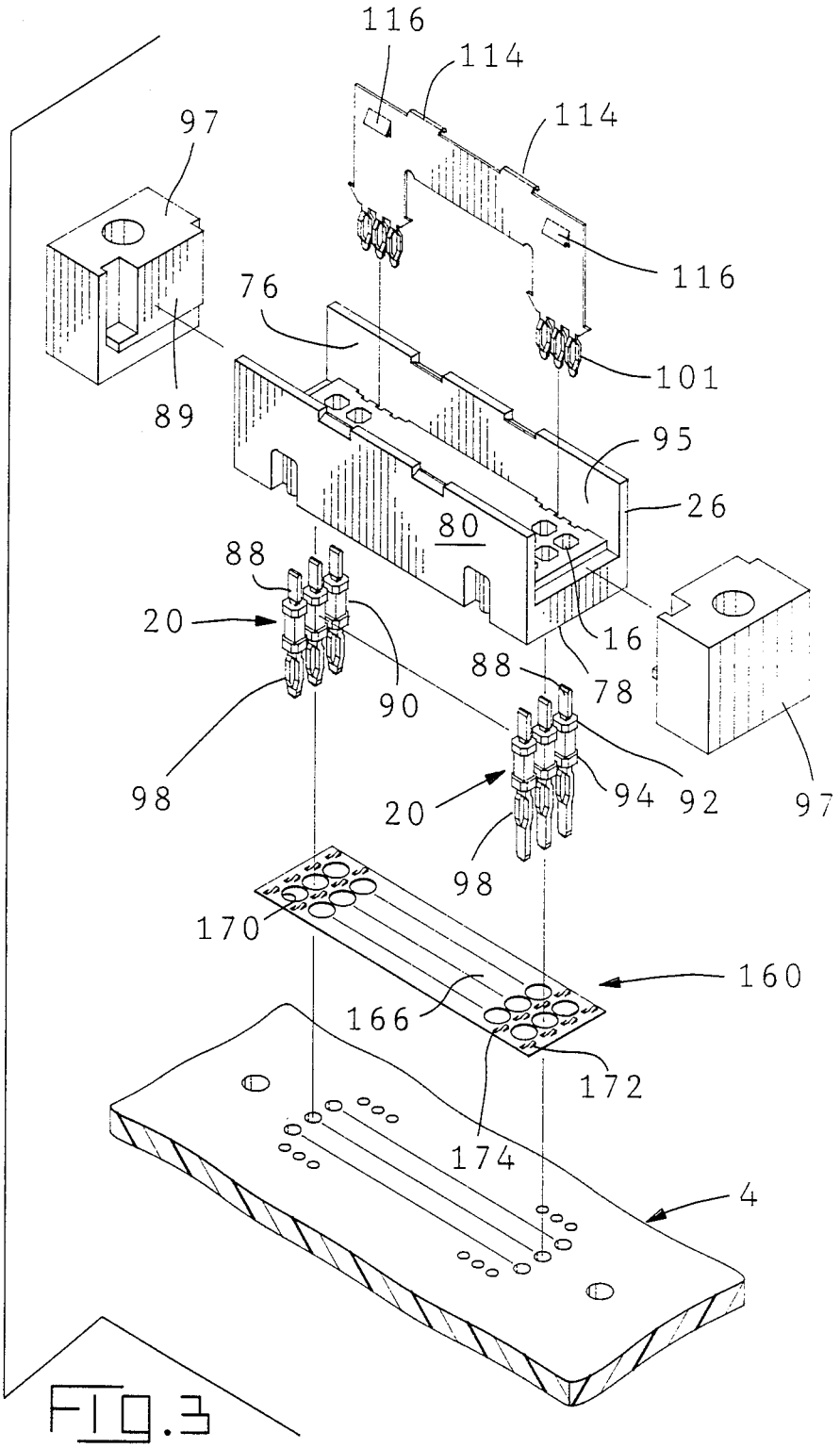
FIG. 3 is an exploded perspective view of the receptacle connector.

Rear surface 28 of mating housing 22 has embossments 27 provided thereon. The embossments, as best shown in FIG. 3, are provided in parallel rows which extend between passages 12. Recesses 29 are provided in the front surface of terminal support conductive housing 24. The configuration of the recesses 29 corresponds to the configuration of the embossments 27. Consequently, as mating housing 22 and terminal support housing 24 are joined together, the embossments 27 cooperate with the recesses 29 to provide an interference fit therebetween.

In this assembled position a plurality of passages 12, 14 extends through connector 8 from front surface 32 of housing 22 to rear surface 34 of housing 24. Passages 12, 14 are arranged in three parallel rows, with the first row being adjacent side surface 36 of housing 22 and side surface 38 of housing 24, the third row being adjacent surface 40 of housing 22, and the second row being between the first and third rows. It should be noted that although three parallel rows are shown and described, any possible configuration of rows is possible.

As shown in FIGS. 4 and 5, each housing 22, 24 has passages 12, 14 which cooperate to form the continuous passages when housings 22, 24 are joined together. However, as passages 14 of support housing 24 are positioned at an angle relative to front surface 30, an angle or bend 42 is necessarily provided in the continuous passages when housings 22, 24 are joined together. Bend 42 shown in FIG. 4 is essentially one hundred thirty-five degrees, but the actual angle can range between one hundred and one hundred seventy degrees, as will be more fully explained below. It should be noted that bend 42 may also be arcuate in shape.

Passages 14 of support housing 24 have uniform cross sections throughout the length of passages 14. However, passages 12 of mating housing 22 have varied non-uniform cross sections. Wide portions 44 of passages 12 are proximate front surface 32 of housing 22 and have a larger diameters than narrow portions 46 of passages 12 which are proximate rear surface 28 of housing 22. This shape of passages 12 enables terminals 18 to be properly secured therein, as will be discussed.

Stamped and formed terminals 18 with dielectric member 48 molded onto terminals 18 are positioned in passages 12. The configuration of dielectric member 48 varies according to the characteristics desired. In the embodiment shown, dielectric member 48 is molded in cylindrical shapes proximate forked ends 50 of terminals 18. Each cylindrical dielectric member 48 has projections 52, 54 extending from either end to secure terminals 18 in passages 14, as well as to provide the spacing required to prevent terminals 18 from engaging housing 22. A dielectric member 56 of spiral configuration is provided proximate cylindrical dielectric member 48. Each spiral dielectric member 56 resembles that of a coil spring which has been slightly stretched, leaving air spaces between the coils, as will be discussed. It should be noted that passages 12, closest to surface 40 are not long enough to support spiral dielectric member 56, therefore cylindrical dielectric member 49 are provided.

The combination of spiral dielectric members 56 with cylindrical dielectric members 48, 49, as shown in FIGS. 2, 4 and 5, not only accurately positions terminals 18 in passages 12 but also provides for air gaps 58 over most of the length of terminals 18. This allows the effective dielectric constant of each passage 12 to approach 1.1, whereas the plastic dielectric constant is substantially higher, for example 3.2. The effective dielectric constant of 1.1 permits the controlled impedance to be approximately 50 ohms with 5 amps per contact and 68 ohms with 3 amps per contact where terminals are positioned on a 0.100" grid. These numbers are merely an example and are not meant to limit the scope of the invention.

Figure 6A:
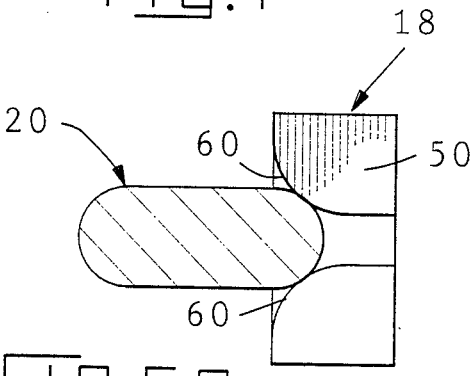
FIG. 6A is a diagrammatic view of a pin just prior to insertion into a terminal.
Figure 6B:
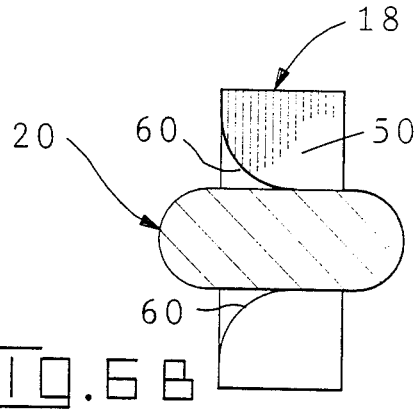
FIG. 6B is a view similar to that shown in FIG. 6A, showing the pin inserted into the terminal.

Each terminal 18 has forked end 50 which is positioned proximate front face 32 of housing 22. Forked end 50 is twisted relative to the rest of terminal 18, allowing forked end 50 to cooperate with a respective pin terminal 20 of receptacle connector 10, as will be discussed. As shown in FIGS. 6A and 6B, each forked end 50 has arcuate surfaces 60 which act as a lead in when pin terminal 20 and forked end 50 are mated together, thereby eliminating the need for pin 20 and forked end 50 to be perfectly aligned when mating occurs.

Extending from forked ends 50 are dielectric engagement portions 62 which have the dielectric inserts molded thereon, as was previously discussed. Portions 62 are of varying lengths, the length depending on passages 12 in which the respective terminals 18 are disposed. Bends 64 are provided in portions 62. Bends 64 correspond to the bends of the continuous passages. The angle of bends 64 is such that reflection of the high speed signals in minimized. Daughter board contact ends 66 are positioned at the end of portions 62 opposite forked ends 50. Ends 66 can be either short, arcuate projections as shown in FIG. 4, or long, straight posts. These alternative mounting means allow for terminals 18 to be respectively surface mounted to board 6 or on plated through holes via compliant section 66*a* of the type disclosed in U.S. Pat. No. 4,186,982. Whichever shape, ends 66 extend from rear surface 22 of support housing 24 to make electrical engagement with daughter board 6.

Terminals 18 with dielectric members 48, 56 molded thereto are inserted into passages 12 through front surface 32 of housing 22. As insertion occurs, projections 52 engage walls of narrow portions 46 of passages 12, causing an interference fit therebetween. Insertion continues until surfaces 68 of projections 54 of dielectric members 48 engage shoulders 12*a* of passages 12 which are the transitions between wide portions 44 and narrow portions 46 of passages 12. It should be noted that as this occurs projections 54 also provide an interference fit with respective walls of wide portions 44 of passages 12. Therefore, terminals 18 are maintained in passages 12 by the interference fit of projections 52, 54 of dielectric member 48 in engagement with walls of passages 12. The portions of terminals 18 extending from rear surface 28 of mating housing 22 are then bent at an appropriate angle as shown in FIGS. 4 and 5. Support housing 24 is inserted over the exposed portions of terminals 18 until front surface 30 of support housing 24 engages rear surface 28 of mating housing 22. To ensure that support housing 24 is not improperly inserted over terminals 18, projection 70 of housing 22 is engaged by housing 24 to ensure that these housings are properly positioned relative to one another.

After housing 24 is positioned onto housing 22, terminals 18 extend beyond rear surface 34 of support housing 24. The remaining exposed portions of terminals 18 is then bent according to the use of assembly 2. Either terminals 18 are cut and bent into arcuate projections of the type required for surface mounting or terminals 18 are bent as needed, enabling the exposed posts to be used in cooperation with a circuit board that requires plated through hole mounting to ensure electrical engagement. Projections 72 extend from rear surface 34 of housing 24 to cooperate with daughter board 6 when connector 8 is positioned on board 6, maintaining the spacing required between connector 8 and board 6. Daughter board 6 is maintained in contact with connector 2 by screws or the like which extend through holes in mounting members 74 of support housing 24 to cooperate with respective holes of board 6. Mounting members 74 have projections 75, and slots 77 which cooperate with projections 79, 81 on respective housings 24, 22 to secure housings 22, 24 together, as well as secure housings 22, 24 to members 74.

Receptacle connector 10 includes conductive housing 26 having a front surface 76 and a rear surface 78. Passages 16 extend through housing 26 from front surface 76 to rear surface 78. Passages 16 are arranged in three parallel rows, with the first row being adjacent sidewall 80, the third row being adjacent sidewall 82, and the second row being between the first and third rows. The rows of passages 16 of receptacle connector 10 align with the rows of passages 12 of mating housing 22 of plug connector 8 enabling the connectors to be electrically mated together. It should be noted that although three parallel rows are shown and described, any possible configuration of rows is possible, as long as rows of receptacle connector 10 align with rows of plug connector 8.

Figure 7:
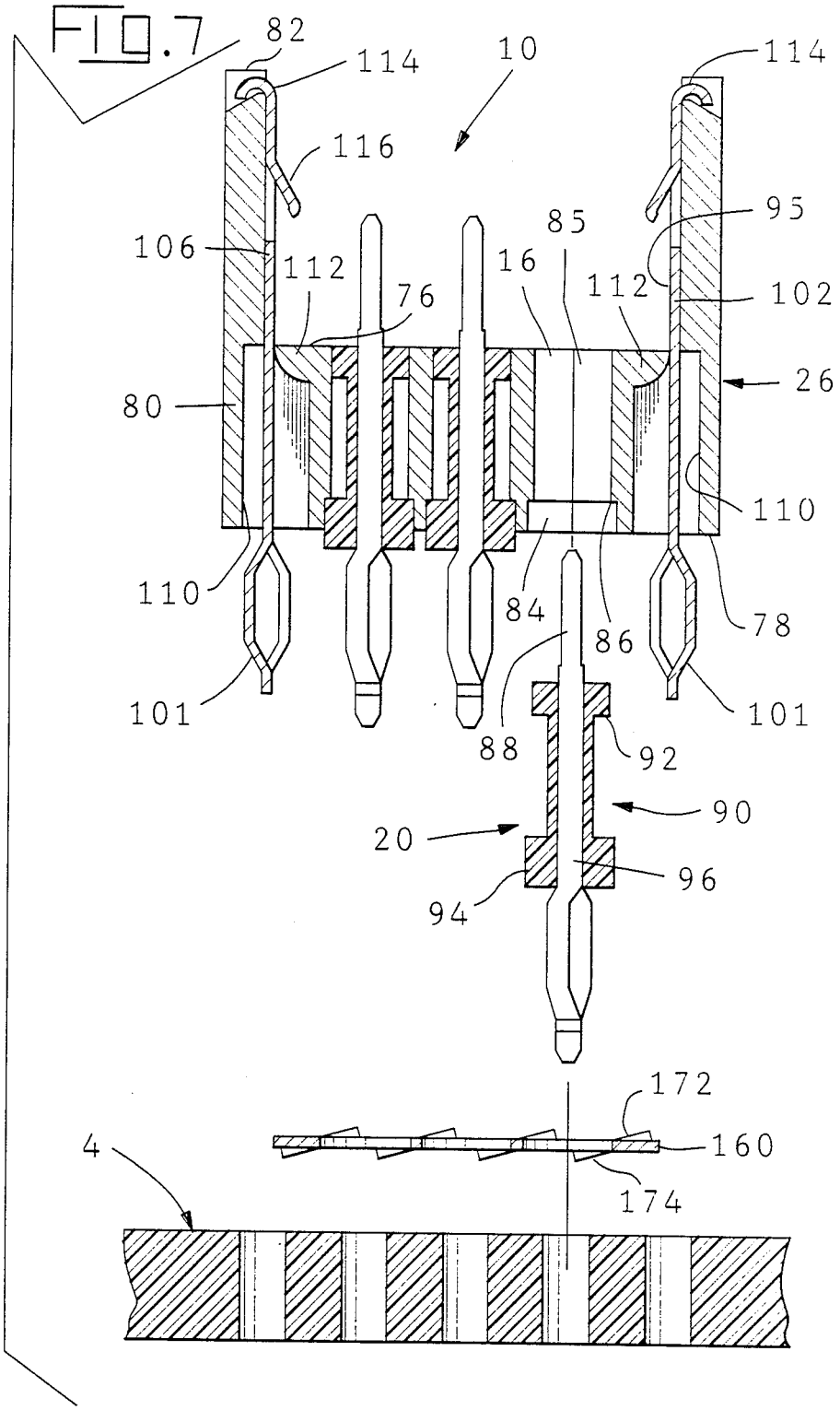
FIG. 7 is a partially exploded cross-sectional view of the receptacle connector.

Passages 16 of housing 26 have non-uniform cross sections as shown in FIG. 7. Portions 84 of passages 16, adjacent rear surface 78, have a larger diameter than portions 85 which extend front surface 76. This non-uniform shape of passages 16 enables terminals 20 to be properly secured therein, as will be discussed.

Stamped and formed pin terminals 20, shown in FIGS. 3–5, are positioned in passages 16. Terminals 20 are essentially straight and have a narrow end 88 at one end thereof. Dielectric member 90 is insert molded over the terminals such that the configuration of dielectric member 90 varies according to the characteristics desired. In the embodiment shown in FIGS. 3–5, dielectric member 90 is molded in a cylindrical shape having projections 92, 94 extending from ends thereof to secure terminals 20 in passages 16, as well as to provide the spacing required, ensuring that terminals 20 are positioned a proper distance away from the wall of passages 16, permitting controlled impedance.

Narrow ends 88 of terminals 20 extend from housing 26, past front surface 76 into a cavity 95 formed by the walls 80, 82 of housing 26. Extending from ends 88 are dielectric engagement portions 96 which have dielectric members 90 insert molded thereon. Mother board contact ends 98 are positioned at the end of portions 96 opposite ends 88. Ends 98 extend from rear surface 78 of housing 26 to make electrical engagement with mother board 4. FIG. 3 shows connector 10 having terminals 20 with posts including compliant sections for electrical connection with plated through holes of mother board 4, however, connector 10 can have terminals 20 which have arcuate ends suited for electrical engagement with contact pads of mother board 4, i.e. surface mounting.

Terminals 20 with dielectric members 90 molded thereto are inserted into passages 16 of receptacle connector 10 through rear surface 78. As insertion occurs, projections 92 cooperate with the walls of narrow portions 85 to provide an interference fit. Insertion continues until surfaces 99 of projections 94 engage shoulders 86 between narrow portions 86 and wide portions 84 of passages 16, thus defining a stop position. Projections 94 also provide an interference fit with the walls of wide portions 84 of passages 16. Therefore, terminals 20 are maintained in this position by the interference fit of projections 92, 94 in cooperation with the walls of passages 16 of connector 10. Mother board 4 acts as a secondary securing means for terminals 20. As connector 10 is brought into contact with board 4, the dielectric members 90 engage board 4, causing mother board 4 to act as a securing means, maintaining terminals 20 in connector 10. Mother board 4 is secured to connector 10 by screws or the like which cooperate with holes in mounting members 97 of housing 26 of connector 10 and respective holes of mother board 4. Mounting members 97 have projections 89 which cooperate with cavity 95 to maintain connector 10 to board 4 when the screws are secured in place. The screws have positioning posts 93 extending upward therefrom, posts 93 cooperating with openings 91 in members 74 to align connector 8 with connector 10.

It should be noted that mounting members 74 and 97 have recesses and projections which cooperate with the ends of connectors 8 and 10 respectively to secure members 74, 97 to connectors 8, 10. If a longer connector assembly is desired a special end block is provided which enables connector assemblies to be connected together in one long connector. The special end blocks actually being intermediate blocks which allow connection of the connector while providing periodic securing means.

It is important to realize that all the various metallized plastic housings must be in electrical engagement with each other in order for a continuous electrical ground path to be provided. As was previously discussed, embossments 27 and recesses 29 are provided to insure that a positive electrical ground connection is provided between housings 22 and 24. However, this same solution cannot be used between circuit board 4 and housing 26, between housing 26 and housing 22, and between housing 24 and circuit board 6. Consequently, a different solution must be employed. In order to provide the electrical connection required, interconnections members 160,162,164 are provided between circuit board 4 and housing 26, between housing 26 and housing 22, and between housing 24 and circuit board 6.

Interconnection members 160,162,164, as best shown in FIGS. 2, 3 and 4, are essentially identical. For ease of description, only interconnection member 162 will be discussed in detail. The reference numbers used will be used on the other interconnection members 160,164, as the parts are identical.

Interconnection member 162 is stamped and formed from any material having the desired conductive characteristics. Member 162 has a first major surface 166 and a second major surface 168. Openings 170 extend from first major surface 166 through second major surface 168. The pattern in which openings 170 are arranged corresponds to the pattern of the terminals. Cantilever spring arms 172, 174 are provided proximate openings 170. Cantilever spring arms 172, 174 are positioned in parallel rows, the pattern of spring arms 172, 174 is essentially identical to the pattern of embossments 27 provided on housing 22. Spring arms 172 extend beyond first major surface 166 and spring arms 174 extend beyond second major surface 168. Consequently, as the various housings and circuit boards are mated together, interconnection members 160, 162, 164 will cooperate with the mating surfaces to provide the electrical connection required. This is insured because spring arms 172, 174 will engage respective surfaces as mating occurs. In fact, spring arms 172, 174 will create a slight wiping action to insure that a positive electrical connection is made. Therefore, as all the housings and circuit boards are in electrical engagement, a uniform electrical ground path is provided around each terminal insuring that the proper signal reference path and shielding is present.

As shown in FIGS. 5 and 7, power busses 100, 102 and ground busses 104, 106 are provided on connectors 8, 10. The general shape of busses 100, 102, 104, 106 of connectors 8, 10 are essentially the same as the shape of the outside surfaces of the respective connectors 8, 10 with which the busses cooperate. Power busses 100, 102 have a layer of dielectric material provided thereon, to prevent the power from travelling from the busses to the metallized housing. Each bus has pins 101 extending from the end of the bus which is adjacent the respective circuit board. Pins 101 are provided on 0.100 inch centerlines, such that upon placement of the busses on appropriate circuit boards, pins 101 may be removed according to need. Accordingly, only pins 101 which correspond to appropriate areas of engagement with the circuit board are retained, the rest are removed.

Power and ground busses 100, 104 of plug connector 8, FIG. 5, are inserted into channels 108 of mating housing 22 and retained therein by an interference fit. Busses 100, 104 are provided to span the entire length of connector 8. The shape of the ends of busses 100, 104 which cooperate with board 6 can be either arcuate or straight to correspond to the shape of the ends of terminals 18 which allows for surface mounting or through hole mounting respectively.

Power and ground busses 102, 106 of receptacle connector 10, FIG. 7, are inserted into respective passages 110 of housing 26 of connector 10. Projections 112 of passages 110 cooperate with busses 102, 106 to provide an interference fit to maintain busses 102, 106 in position. As can be seen from FIG. 7, ground bus 106 and power bus 102 have similar configurations. Arcuate sections 114 are provided periodically at an end of each bus 102, 106, such that sections 114 cooperate with the walls of housing 26 to prevent movement of busses 102, 106 relative to connector 10, as shown in FIGS. 1 and 7. The ends of busses 102, 106 may be either arcuate or straight to correspond to the shape of the ends of terminals 20 and to allow for either surface mounting or through hole mounting.

Projections 116 are present on busses 102, 106 of connector 10 such that projections 16 electrically and wipingly engage busses 100, 104 of connector 8 when connectors 8, 10 are mated together. This ensures that that as connectors 8, 10 are mated together, power and ground busses 100, 104 make electrical contact with the respective power and ground busses 102, 106 of the mating connector. Consequently, a power and a ground bus is supplied between mother board 4 and daughter board 6, providing the required power supply necessary to ensure that daughter board 6 functions properly, as well as providing a shielding to shield the connector assembly 2 from outside interference.

Connector assemblies 2 are designed such that the number of terminals which can be used in a small space is maximized. This important feature causes problems when the connectors are to be mated together. The force required for proper insertion is too great, and therefore, improper insertion or failure of the connectors is a likely occurrence. Consequently, a zero or low insertion connector assembly is essential for effective operation.

Figures 8, 10:
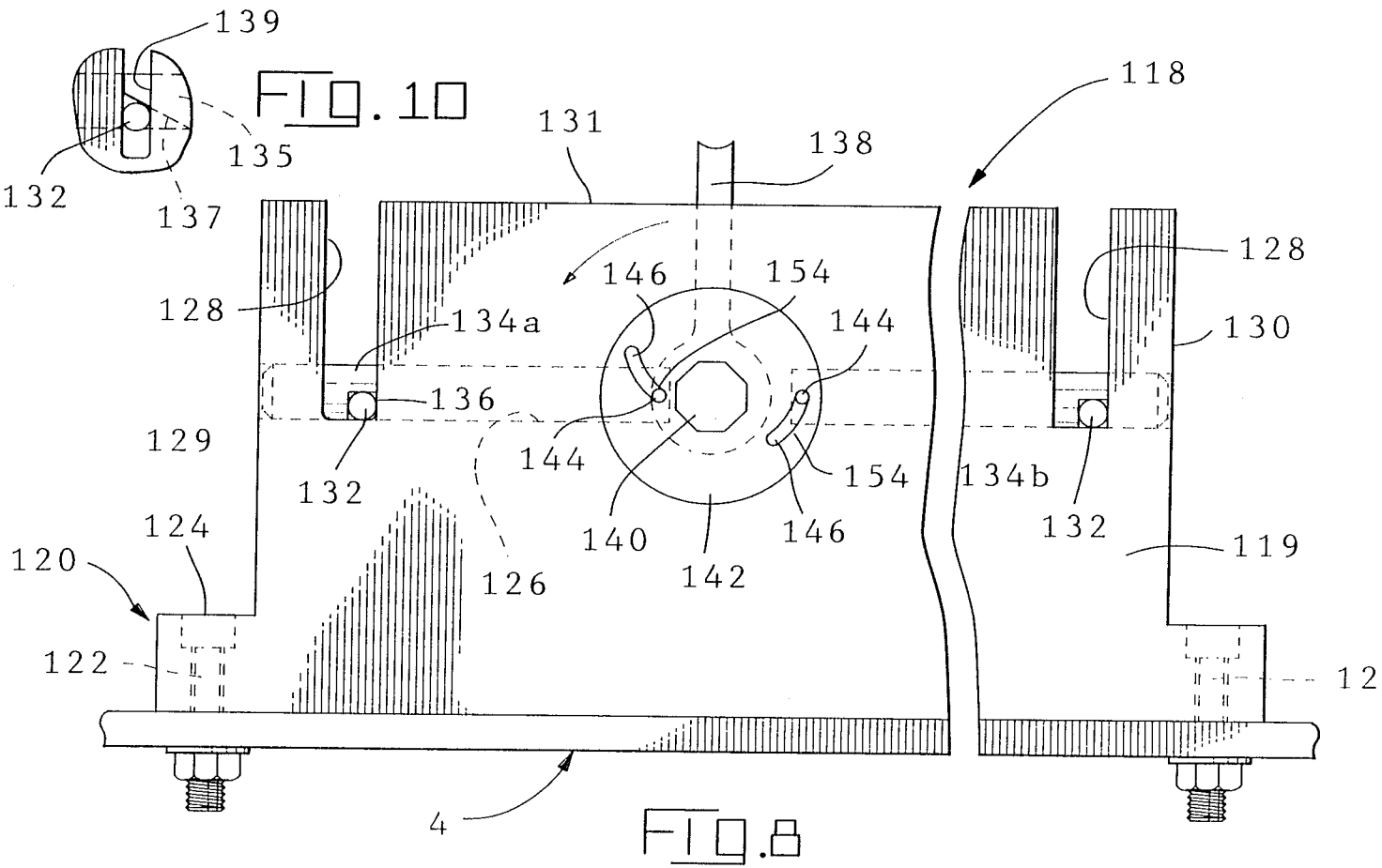
FIG. 8 is a partial elevational view of a camming member.
FIG. 10 is a fragmentary view showing an alternative embodiment of the camming rod.
Figure 9:
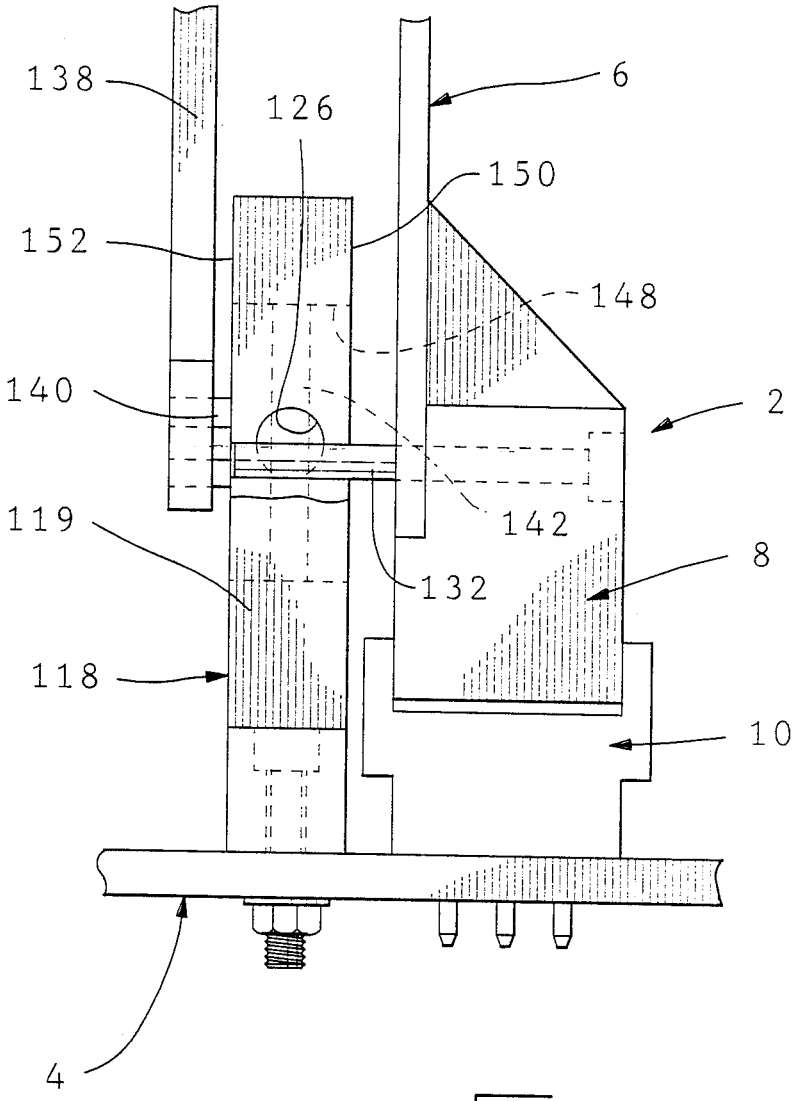
FIG. 9 is an end elevational view of the camming member and assembly.

One form of zero or low insertion force connector requires the use of a camming assembly. FIGS. 8 and 9 show one type of camming assembly 118 which can be used in conjunction with connector assembly 2. Camming assembly 118 extends the entire length of connector assembly 2. Mounting projections 120 extend from ends 129, 130 of member 119 such that openings 122, provided in mounting projections 120, are configured to accept bolts 124 which align with corresponding holes of board 4. The use of bolts 124 allows camming assembly 118 to be secured to board 4.

Referring to FIG. 8, opening 126 extends through member 119 from end 129 to end 130. Camming rods 134*a*, 134*b* are movably positioned in opening 126. Recesses 128 are provided in member 119 adjacent ends 129, 130 and extend from top surface 131 in communication with opening 126. Recesses 128 are provided to accept rods 132 which extend from connector 8 of connector assembly 2 through board 6 (as shown in FIG. 9). Recesses 136 of rods 134*a*, 134*b* align with recesses 128 such that rods 132 are disposed in recesses 136, as shown in FIG. 8. As rods 134*a*, 134*b* are moved, recesses 136 cause rods 132 to move within recesses 128. This movement forces connector 8 to move in a direction which is parallel to the plane of board 4. Consequently, connector 8 moves relative to connector 10, forcing terminals 18 into electrical engagement with terminals 20 as will be explained.

Terminals 20 of receptacle connector 10 are inserted to the side of terminals 18 of plug connector 8 as connectors 8, 10 are mated together, as shown in FIG. 6. In other words as connectors 8, 10 are mated together terminals 18 and terminals 20 do not contact or barely contact each other. This allows connectors 8, 10 to be mated together under low insertion force conditions and also provides the important feature of assuring that power busses 100, 104 and ground buss 102, 106 are in electrical engagement before signal terminals 18, 20 are placed in electrical engagement with each other. Once connectors 8, 10 have been brought into engagement, camming assembly 118 is operated, causing plug connector 8 to move relative to receptacle connector 10. Consequently, pins 20 are forced into engagement with lead in arcuate surfaces 60 of forked ends 50 of terminals 18, shown in FIG. 6A. As this camming motion occurs, terminals 20 contact the sides of forked ends 50, thereby providing a wiping action to ensure that a positive electrical connection is effected. In the fully cammed position, FIG. 6B, terminals 20 are fully inserted into forked ends 50, thereby maintaining a positive electrical connection.

The movement of rods 134*a*, 134*b* is caused by the movement of action lever 138, as shown in FIGS. 8 and 9. Action lever 138 is connected to activation rod 140 which is in turn connected to a camming wheel 142. Wheel 142 is connected to rods 134 by pins 144 disposed in arcuate camming slots 146 of wheel 142, as shown in FIG. 8. Consequently, as lever 138 is turned in the direction of the arrow in FIG. 8, rod 140 is rotated causing wheel 142 to rotate which in turn causes pins 144 to move in camming slots 146. The configuration of camming slots 146 cause rod 134*a* to move outwardly, away from wheel 142, while rod 134*b* is moved inwardly, toward wheel 142. The movement of rods 134*a*, 134*b* cause rods 132 to move in the same direction, which in turn causes connector 8 to move as previously described. Consequently, as lever 138 is turned, terminals 18 are moved into electrical engagement with terminals 20.

Wheel 142 is positioned in opening 148 of member 119 which extends through camming assembly 118 from side 150 to side 152 (FIG. 9). To hold wheel 142 in place rods 134*a* and 134*b* have slots positioned at the ends thereof which cooperate with opening 148. Wheel 142 is positioned in the slots and pins 144 are inserted through openings 154 provided in rods 134*a* and 134*b*, thereby securing wheel to rods 134*a*, 134*b*. In order to change wheel 142 and camming rods 134*a*, 134*b*, pins 144 are removed allowing the wheel and the camming rods to be replaced as required.

Another configuration of camming assembly 118 has camming rods 135 which have a sloping surface 137, as shown in FIG. 10. Recesses 139 are narrower and longer than the recesses 128 previously described. Arcuate camming slots 146 are also configured in a slightly different manner, such that as wheel 142 is turned, rods 135 are moved outward, away from wheel 142. Consequently, as rods 135 are moved outward, away from wheel 142. Consequently, as rods 135 are moved, surfaces 137 cooperate with rods 132, forcing them downward. As rods 132 are attached to connector 8, the downward motion of rods 132 forces connector 8 to move downward relative to connector 10. This downward motion causes terminals 18 to be electrically connected to terminals 20, thereby providing a positive locking action between terminals 18 of connector 8 and terminals 20 of connector 10.

Camming assembly 118 also acts as a stiffening member. Board 4 is subject to warpage and bending, which causes the string of connected assemblies 2 to bend accordingly, causing an unreliable electrical connection to occur between terminals 18 and terminals 20. Consequently a stiffening member can be useful. Camming assembly 118, is manufactured from a metal and other material having the required characteristics and is secured to board 4 by bolts 124 and therefore, provides the stiffening required to insure that the board is only subjected to minimal bending, which in turn insures that a reliable electrical connection is effected between the terminals.

It must be noted that although camming assembly 118 is shown in detail, other types of camming assemblies will perform equally as well. The camming assembly must move the terminals into electrical engagement, ensuring that a positive electrical connection is affected and maintained.

We claim:

1. An electrical connector comprising:

a first electrically conductive housing having at least one row of first passages therein, each first passage extending from a first surface to a second surface of the first housing;

a second electrically conductive housing having at least one row of second passages therein, each second passage extending from a first surface to a second surface of the second housing, each second passage is at an angle relative to the first and the second surface of the second housing, such that as the first and second housings are brought together the passages of the respective housings align to form terminal receiving passages which extend through the connector, the terminal receiving passages having a bend at the juncture of the housings;

the first and the second housings are metallized plastic such that the properties of the surface layers of the first and the second housings have conductive characteristics;

terminals positioned in the passages, each terminal having a first end proximate the first surface of the first housing and a second end proximate the second surface of the second housing, the terminals being configured to follow the shape of the terminal receiving passages, such that bends are provided in the terminals to allow high speed transmission of a signal transmission across the terminal while minimizing reflection of the signal, thereby ensuring that the high speed signal is properly transmitted across the terminals of the connector; and dielectric sleeves coaxially positioned around the terminals, portions of the sleeves cooperate with walls of the passages and with the terminals to provide spacing between the housing and the terminals, the dielectric sleeves having spaces provided therein, the spaces providing air gaps which allows the characteristic impedance to be such as to permit the high speed signals to be transmitted properly across the terminals.

2. An electrical connector as recited in claim 1 wherein the bends are angles which are in the range from one hundred degrees to one hundred seventy degrees.

3. An electrical connector as recited in claim 1 wherein the bends are radiussed or curved paths.

4. An electrical connector as recited in claim 1 wherein the second end of the terminals is arcuate in shape to allow for surface mounting of the connector to a substrate.

5. An electrical connector as recited in claim 1 wherein the second end of the terminals is bent at an angle to allow for through hole mounting of the connector to a substrate.

6. An electrical connector as recited in claim 1 wherein the dielectric sleeves proximate the first end of the terminals are cylindrical in configuration.

7. An electrical connector as recited in claim 6 wherein the dielectric sleeves have projections which cooperate with walls of the passages to provide an interference fit, maintaining the terminals in the passages, the projections also providing an air gap over most of the length of the terminals, allowing for controlled impedance.

8. An electrical connector as recited in claim 1 wherein power and ground members are provided on the outside surfaces of the electrical connector.

9. An electrical connector as recited in claim 8 wherein the power and ground members are provided with pins which cooperate with corresponding holes of a mother board.

10. An electrical connector as recited in claim 1 wherein the first ends of the terminals are formed into a fork, the fork having arcuate surfaces on one side thereof, the surfaces act as a lead-in when the electrical connector is mated to a mating electrical connector.

11. An electrical connector as recited in claim 10 wherein camming assembly means is provided to cam the first ends of the terminals of the electrical connector into electrical engagement with terminals of the mating electrical connector.

12. An electrical connector as recited in claim 11 wherein a power and a ground bus of the electrical connector electrically engage a respective power and ground bus of the mating connector before the terminals of the electrical connector and the mating connector are cammed into electrical engagement.

13. An electrical connector assembly for connecting conductive areas of a first substrate to conductive areas of a second substrate, the connector assembly comprising:

a first electrical connector having electrically conductive housing means, the housing means having at least one row of first terminal receiving passages extending from a first surface of the housing means to a second surface of the housing means, the terminal receiving passages having a bend therein, first terminals located in the terminal receiving passages and having essentially the same configuration as the terminal receiving passages, the first terminals having a mating end proximate the first surface of the housing means and a board engagement end proximate the second surface of the housing means, dielectric means surrounding the first terminals in the first terminal receiving passages, the dielectric means insulating the first terminals from the housing means and providing spacing to properly position the first terminals in the first terminal receiving passages;

a second electrical connector having electrically conductive housing member means, the housing member means having at least one row of second terminal receiving passages extending therethrough, second terminals located in the second terminal receiving passages, a mating end of the second terminals cooperating with the mating end of the first terminals, dielectric material means surrounding the second terminals in the second terminal receiving passages, the dielectric material means insulating the second terminals from the housing member means and providing spacing to properly position the second terminal in the second terminal receiving passages;

the housing means and the housing member means are metallized plastic such that the properties of surfaces of the housing means and housing member means have conductive characteristics; and the dielectric means and the dielectric material means have spaces provided therein, the spaces provide air gaps which allow the characteristic impedance to be such as to permit high speed signals to be transmitted properly across the first and the second terminals.

14. An electrical connector assembly as recited in claim 13 wherein each connector has power and ground busses positioned proximate outside surfaces thereof, the power and ground busses of the first connector being in alignment with respective power and ground busses of the second connector such that electrical engagement is provided between corresponding busses when the connectors are mated.

15. An electrical connector assembly as recited in claim 13 wherein the dielectric means and dielectric material means is configured to provide air gaps over most of the length of the terminals of the first and the second connectors, the air gaps cooperating with the dielectric material means to provide a controlled impedance.

16. An electrical connector assembly as recited in claim 13 wherein camming means is provided to cam the first terminals of the first electrical connector into electrical engagement with the second terminals of the second electrical connector.

17. An electrical connector assembly as recited in claim 15 wherein a power and a ground bus of the first electrical connector is electrically engaged to a respective power and ground bus of the second electrical connector before the first terminals of the first electrical connector are cammed into electrical engagement with the second terminals of the second electrical connector.

18. An electrical connector assembly as recited in claim 13 wherein the housing means of the first connector has two parts, a support member and a mating member, the bend occurring proximate the juncture of the two members.

19. An electrical connector assembly as recited in claim 17 wherein the bends are angles which range from one hundred degrees to one hundred seventy degrees.

20. An electrical connector comprising:

a first electrically conductive housing having at least one row of first passages therein, each first passage extending from a first surface to a second surface of the first housing;

a second electrically conductive housing having at least one row of second passages therein, each second passage extending from a first surface to a second surface of the second housing, each second passage is at an angle relative to the first and the second surface of the second housing, such that as the first and second housings are brought together the passages of the respective housings align to form terminal receiving passages which extend through the connector, the terminal receiving passages having a bend at the juncture of the housings;

terminals positioned in the passages, each terminal having a first end proximate the first surface of the first housing and a second end proximate the second surface of the second housing, the terminals being configured to follow the shape of the terminal receiving passages, such that bends are provided in the terminals to allow high speed transmission of a signal transmission across the terminal while minimizing reflection of the signal, thereby ensuring that the high speed signal is properly transmitted across the terminals of the connector; and dielectric sleeves coaxially positioned around the terminals, portions of the sleeves cooperate with walls of the passages and with the terminals to provide air spacing which is required to ensure that the terminals do not contact the walls of the passages and to provide the desired characteristic impedance to allow the high speed signals to be transmitted properly across the terminals, the dielectric sleeves positioned proximate the second end of the terminals are in the shape of a spiral.

* * * * *